US006051918A

United States Patent [19]

Hayashi et al.

[11] Patent Number: 6,051,918

[45] Date of Patent: Apr. 18, 2000

[54] SHADOW MASK WITH SKIRT

[75] Inventors: Masao Hayashi, Shiga; Kazuya Fushimoto, Kyoto, both of Japan

[73] Assignee: Matsushita Electronics Corporation, Osaka, Japan

[21] Appl. No.: 09/050,754

[22] Filed: Mar. 30, 1998

[30] Foreign Application Priority Data

May 27, 1997 [JP] Japan ..... 9-137245

[51] Int. Cl.[7] ..... H01J 29/07

[52] U.S. Cl. ..... 313/407

[58] Field of Search ..... 313/402, 403, 313/404, 407, 408

[56] References Cited

U.S. PATENT DOCUMENTS 4,678,963 7/1987 Fonda ..... 313/407
5,359,259 10/1994 Reidinger et al. ..... 313/407

FOREIGN PATENT DOCUMENTS 2 134 436 12/1972 France ..... H01J 29/00
8-287840 11/1996 Japan ..... H01J 29/07
8-298078 11/1996 Japan ..... H01J 29/07

*Primary Examiner*—Michael H. Day
*Attorney, Agent, or Firm*—Merchant & Gould P.C.

[57] ABSTRACT

A body of a shadow mask having a skirt portion around the body, wherein cut parts are formed in the skirt portion in the vicinity of corner portions and center portions of the short sides and the length of the skirt portion in the corner portions is longer than the length of the skirt portion in the center portions of the short sides. This enables residual distortion generated during welding with a mask frame and a thermal expansion generated later to be absorbed at the skirt portion, thus restraining the deformation generated by heating a curved surface of the shadow mask. As a result, it is possible to realize cost reduction and to improve productivity in manufacturing a color picture tube without deteriorating the color purity in the color picture tube by preventing the thermal deformation of the curved surface of a shadow mask during manufacturing processes of the color picture tube without a dummy baking process.

7 Claims, 9 Drawing Sheets

SHADOW MASK WITH SKIRT

FIELD OF THE INVENTION

This invention relates to a body of a shadow mask used in a color picture tube, a shadow mask including the body and a color picture tube containing the shadow mask. Particularly, this invention relates to a body of a shadow mask, a shadow mask and a color picture tube that can prevent the color purity in a color cathode-ray tube from deteriorating, which is caused by the deformation of a curved surface of the body, more particularly, to a body of a shadow mask, a shadow mask and a color picture tube that can prevent thermal deformation of the shadow mask during a thermal process in manufacturing processes.

BACKGROUND OF THE INVENTION

As shown in FIG. 4, a shadow mask type color picture tube includes a panel 1, a shadow mask 2, a funnel 3, a deflecting yoke 4, a neck 5, an electron gun 6 and a screen 8. The shadow mask 2 in FIG. 4 is provided for allowing electron beams 7 to land properly on the screen 8 by sorting the electron beams 7 emitted from the electron gun 6.

The shadow mask 2 is made up of a body 9 of a shadow mask and a mask frame 10 as shown in FIG. 5. The body 9 and the mask frame 10 are assembled by welding a skirt portion 11 formed around the body and the inner surface of the mask frame 10 at the center positions of the long sides and short sides and at corner portions of the shadow mask.

Conventionally, the length L of the skirt portion 11 of the body 9 is almost the same over the whole skirt portion, i.e. in each center portion of the sides and in each corner portion, or in the case where a "boss" for reinforcing the mask frame 10 is provided in the inner part of each corner portion of the mask frame 10, in order to avoid that the length of the skirt in each corner portion is shorter than the length of the skirt in each center portion of the sides. In welding the body 9 and the mask frame 10, the deformation of the skirt portion 11 relates greatly to the deformation of the curved surface shape if the welding points are set at the upper part of the skirt portion 11 (the side near the curved surface of the body 9). On the other hand, there might be a case where the position of the welding points cannot be secured due to an assembly error or the like in the case where the welding points are set at the lower end part of the skirt portion 11. Thus, the appropriate position of welding points is usually about 2 mm above the lower end of the skirt portion 11.

Cut parts 12 are provided in the vicinity of the welding points of the skirt portion 11 and the mask frame 10, i.e. in the vicinity of each corner portion of the shadow mask 2 and each center portion of the long and short sides. The cut parts 12 are provided in order to prevent excess thickness in forming the skirt portion 11 by press-molding a sheet metal and the deformation of the curved surface of the mask, which is produced by a temperature rise of the body 9 caused by the collision of an electron beam while a color picture tube is working.

In such a shadow mask 2, the skirt portion and the mask frame 10 are welded after setting the skirt portion 11 into the mask frame 10 by pushing the skirt portion 11 into the mask frame 10 in order to maintain the curved surface of the body 9. Consequently, stress distortion tends to be left at the fixing points of the skirt portion 11 and the mask frame 10 and at the welding points pressed mutually by a welding machine.

When manufacturing a shadow mask type color picture tube, the shadow mask 2 is mounted to the inner side of the panel 1 that has been provided with the screen 8, and a frit sealing process, an exhaust process and the like are conducted for the panel 1 and the funnel 3. Therefore, the above-mentioned distortion remaining in the welding parts in the shadow mask 2 and in their circumference are released by heating or the like during such processes (a frit sealing process, an exhaust process and the like), resulting in deformation of the curved surface of the body 9. This deformation of the curved surface of the body 9 causes deterioration of the color purity in a color cathode-ray tube.

The materials used for the body 9 of a shadow mask include an aluminum-killed steel (hereafter referred to as an AK material) having a thickness of about 0.1–0.3 mm, an invar material (a low expansion material) that has been developed according to the recent trend toward large size and high intensity of a picture tube or the like. The mask frame 10 is generally formed using a soft steel. An examination as to the deformation of the body 9 during manufacturing processes was carried out for the 2 kinds of shadow masks (made of an AK material and made of an invar material). As a result, it was confirmed that the deformation in the shadow mask made of an invar material was greater than that in the shadow mask made of an AK material.

It can be considered that the difference in the deformation of the body 9 is caused by the difference in the thermal expansion in the body 9 and in the mask frame 10. A shadow mask made of an AK material (hereafter also referred to as "an AK mask", has almost the same coefficient of thermal expansion as the mask frame 10. However, the coefficient of thermal expansion of a shadow mask made of an invar material (hereafter also referred to as "an invar mask") is smaller than that of the mask frame 10. Consequently, it can be considered that the body 9 tends to be affected by the difference in the thermal expansion at welding parts.

Conventionally, a dummy baking treatment (for example, at least at 450° C. for 40–50 minutes) that eliminates the deformation caused by the distortion beforehand by heating the shadow mask 2 has been conducted during manufacturing processes for the purpose of the prior elimination of various thermal deformation mentioned above created in the body 9 or the like by sealing, exhaust heating and the like of the panel 1 and the funnel 3.

In a shadow mask according to conventional techniques, in the case of assembling a color picture tube without conducting such a dummy baking treatment, a shift is created between a phosphor hole and an electron beam in the color picture tube.

FIG. 6 is a front view of a 36 cm (15 inch type) invar mask tube seen from the panel side as an example of a color picture tube according to the present invention. A screen has been formed on the inner surface of a panel 1. As shown in FIG. 6, phosphor holes having a unit made of red (R), green (G) and blue (B) are arranged regularly in the screen. Here attention should be paid to a phosphor hole unit 17 in the area near corner portions and a phosphor hole unit 18 in the area near center portions of the short sides. In FIG. 6, the phosphor hole units 17 and 18 are shown in an exaggerated manner to express the concept.

FIG. 7 shows a shift created between the phosphor hole and an electron beam. FIG. 7(*a*) shows an enlarged view of the phosphor hole unit 17 arranged in the area near corner portions in FIG. 6, and FIG. 7(*b*) shows an enlarged view of the phosphor hole unit 18 arranged in the area near center portions of the short sides in FIG. 6. In the area 17 near the corner portions of a color picture tube, an electron beam 20 shoots the outer side of a phosphor hole 19 as shown in FIG.

7(*a*), and in the area 18 near the center portions of the short sides of the color picture tube, the electron beam 20 shoots the inner side of the phosphor hole 19 as shown in FIG. 7(*b*), resulting in a shift between the electron beam 20 and the phosphor hole 19. It was confirmed that the total (d1+d2) of the shifted distance at landing in the area near the corner portions and in the area near the center portions of the short sides was 40 μm as shown in FIG. 2 (explained below in detail).

FIG. 8 shows the change of the curved surface of a mask before and after conducting a heat treatment in the area near corner portions and in the area near center portions of short sides in a color picture tube. That is, FIG. 8(*a*) schematically illustrates the state of the change in curvature of the shadow mask surface, taken along the line I—I in FIG. 6, seen from the direction of the arrow. The alternate long and short dash line 22' and an unbroken line 22 show the reference curved surface before conducting a heat treatment for the mask and the curved surface after conducting a heat treatment for the mask respectively. FIG. 8(*b*) schematically illustrates the state of the change in curvature of the shadow mask surface, taken along the line II—II in FIG. 6, seen from the direction of the arrow. The alternate long and short dash line 23' and an unbroken line 23 show the reference curved surface before conducting a heat treatment for the mask and the curved surface after conducting a heat treatment for the mask respectively. As shown in FIG. 8, the curved surface 22 in the area near the center portions of the short sides shifts in the direction approaching to the phosphor and the curved surface 23 in the area near the corner portions shifts in the direction away from the phosphor compared to the reference curved surfaces 22' and 23' respectively. It was confirmed that the total (d3+d4) of the shift d3 in the curved surface 22 in the area near the center portions of the short sides and the shift d4 in the curved surface 23 in the area near the corner portions was 40 μm.

It was found from the measurement results of FIG's. 7 and 8 that the change of the curved surface and the properties of an assembled color picture tube corresponded. In the further examination in detail, it was confirmed that there was a correlation between the total (d3+d4 in FIG. 8) of the shift in the curved surface and the total (d1+d2 in FIG. 7) of the shift (between an electron beam and a hole) at landing in the area near the center portions of the short sides and in the area near the corner portions as shown in FIG. 9.

In order to obtain a precise color picture, it is preferable that the total (d1+d2 in FIG. 7) of the shift at landing is restrained to 15 μm or smaller, and it can be found from FIG. 9 that in order to restrain the total to 15 μm or smaller the total (d3+d4) of the shift of the curved surface needs to be not greater than 15 μm.

In a shadow mask according to conventional techniques as mentioned above, as can be seen from the test (research) results, even if a body of a shadow mask is made of an AK material that deforms thermally in a relatively low level (not to mention in the case of using a body of a shadow mask made of an invar material that deforms greatly especially during a thermal process), the body deforms thermally through a frit sealing process, an exhaust heating process and the like for a panel and a funnel. Consequently, in order to obtain a shadow mask having better precision, it is necessary to assemble the shadow mask after eliminating the residual distortion by making the shadow mask deform sufficiently beforehand through a heat treatment. Therefore, a dummy baking treatment has been indispensable.

It is necessary that this dummy baking is conducted at not lower than 450° as a maximum temperature and for not shorter than 40–50 minutes as a holding time as mentioned above, since the heating value provided to a shadow mask by the dummy baking must be greater than that provided by a heating process conducted later. It takes about 3 hours for the whole dummy baking process.

In manufacturing a color picture tube, it has been a big problem on production efficiency and production cost that the processes requiring enormous time and energy are necessary.

SUMMARY OF THE INVENTION

The present invention is directed to solve such problems. The object of the present invention is to provide a body of a shadow mask, a shadow mask and a color picture tube that can prevent color purity in the color picture tube from deteriorating by preventing the thermal deformation of the curved surface of the shadow mask during manufacturing processes of the color picture tube without a dummy baking process, and that can also realize cost reduction and improvement in productivity in manufacturing processes of the color picture tube.

A body of a shadow mask having a peripheral skirt portion and short sides according to the present invention for attaining the object mentioned above is characterized in that cut parts are formed in the skirt portion in the vicinity of corner portions and center portions of the short sides of the body and the length of the skirt portion in the corner portions is longer than that of the skirt portion in the center portions of the short sides.

A shadow mask according to the present invention for attaining the object mentioned above comprises a body of a shadow mask having a peripheral skirt portion and short sides and a mask frame surrounding the body and is characterized in that cut parts are formed in the skirt portion in the vicinity of corner portions and center portions of the short sides of the body. The skirt portion and the inner surface of the mask frame are fixed at least at the corner portions and the center portions of the short sides and each fixing point in the center portions of the short sides is nearer to the curved surface of the shadow mask than is a straight line that links two fixing points, each of which is positioned in a corner portion and between which the fixing point in the center portion of the short side is positioned.

A shadow mask according to another structure of the present invention comprises a body of a shadow mask having a peripheral skirt portion and short sides, and a mask frame surrounding the body, wherein the skirt portion and an inner surface of the mask frame is fixed. The shadow mask is characterized in that cut parts are formed in the skirt portion in the vicinity of corner portions and center portions of the short sides of the body and the length of the skirt portion in the corner portions is longer than that of the skirt portion in the center portions of the short sides.

A color picture tube according to the present invention for attaining the object mentioned above comprises a shadow mask that in turn comprises a body of a shadow mask having a peripheral skirt portion and short sides, and a mask frame surrounding the body, includes a shadow mask in which the skirt portion and an inner surface of the mask frame are fixed and is characterized in that cut parts are formed in the skirt portion in the vicinity of corner portions and center portions of the short sides of the body. The length of the skirt portion in the corner portions is longer than that of the skirt portion in the center portions of the short sides.

A color picture tube according to another structure of the present invention comprises a body of a shadow mask having a peripheral skirt portion and short sides and a mask frame surrounding the body and is characterized in that cut parts are formed in the skirt portion in the vicinity of corner portions and center portions of the short sides of the body. The color picture tube comprises a shadow mask in which the skirt portion and the inner surface of the mask frame are fixed at least at the corner portions and the center portions of the short sides and each fixing point in the center portions of the short sides is nearer to the curved surface of the shadow mask than is a straight line that links two fixing points, each of which is positioned in a corner portion and between which the fixing point in the center portion of the short side is positioned.

According to the present invention, since the skirt portion in the corner portions is formed so as to be longer than the skirt portion in the center portions of the short sides or each fixing point in the center portions of the short sides is nearer to the curved surface (the panel) of the shadow mask than the straight line that links two fixing points, each of which is positioned in a corner portion and between which the fixing point in the center portion is positioned, the skirt portion absorbs thermal expansion displacement caused by welding. As a result, the deformation of the skirt portion does not affect the curved surface of the shadow mask, thus reducing the shift of the curved surface and also the total of the shift (between an electron beam and a hole) at landing. Consequently, it is possible to realize cost reduction and to improve productivity in manufacturing processes of a color picture tube without deteriorating the color purity in the color picture tube, since the thermal deformation of the curved surface of a shadow mask during manufacturing processes of a color picture tube can be prevented without a dummy baking process.

In a body of a shadow mask, a shadow mask or a color picture tube according to the present invention, it is preferable that the relationship between the length of the skirt portion in the corner portions and the length of the skirt portion in the center portions of the short sides is expressed by the following formula.

(Formula 1)

$$2 \leqq L_1 - L_2 < 15$$

$L_1$: the length of a skirt portion in corner portions (mm)

$L_2$: the length of a skirt portion in center portions of the short sides (mm)

In a shadow mask or a color picture tube according to the present invention, it is preferable that the distance between a fixing point in a center portion of a short side and the straight line that links two fixing points, each of which is positioned in a corner portion and between which the fixing point in the center portion is positioned, is shorter than 15 mm but not shorter than 2 mm.

According to this preferable example, the effect of the present invention can be exhibited effectively by forming the skirt portion in corner portions so as to be longer than the skirt portion in center portions of the short sides by at least 2 mm or by providing a distance of at least 2 mm between a fixing point in a center portion of a short side and the straight line that links two fixing points, each of which is positioned in a corner portion and between which the fixing point in the center portion is positioned. There is no great substantial difference in the effect in the case where the difference between the length of the skirt portion in the corner portions and the length of the skirt portion in the center portions of the short sides is at least 15 mm or the distance between a fixing point in a center portion of a short side and the straight line that links two fixing points, each of which is positioned in a corner portion and between which the fixing point in the center portion is positioned, is at least 15 mm. In the case where the difference is at least 15 mm, it becomes difficult to secure the positions for welding, the appropriate distance between a panel and a shadow mask, or the like. According to the preferable example, the effect of the present invention can be obtained in the range free from the restrictions in manufacturing a color picture tube by specifying the length of the skirt portion in the corner portions and in the center portions of the short sides so as to have the relationship expressed by Formula 1 mentioned above or the distance between a fixing point in a center portion of a short side and the straight line that links two fixing points, each of which is positioned in a corner portion and between which the fixing point in the center portion is positioned, so as to have the range mentioned above.

DETAILED DESCRIPTION OF THE INVENTION

An embodiment according to the present invention will be explained referring to drawings and examples as follows.

Figure 4:
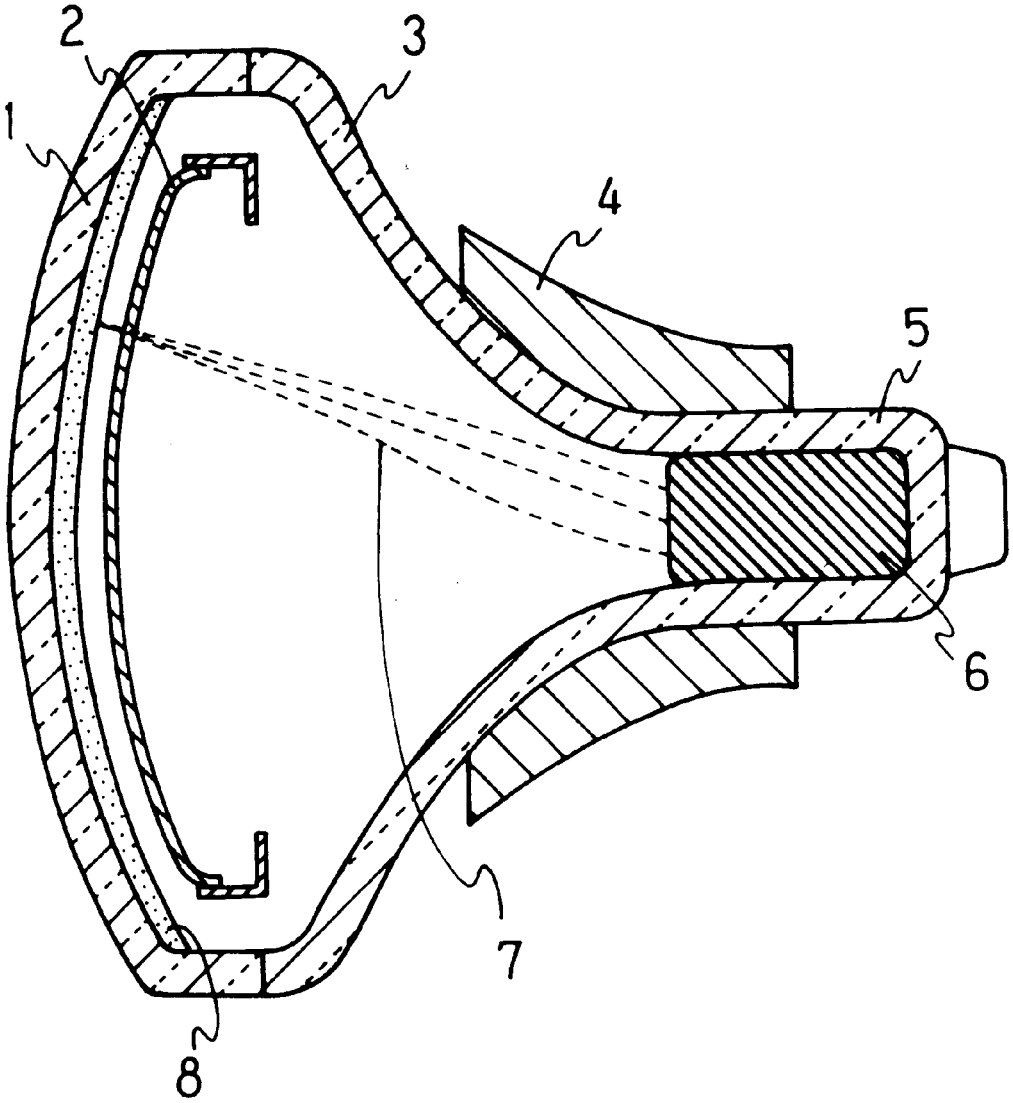
FIG. 4 PRIOR ART
FIG. 4 shows a schematic sectional view of a color picture tube.

FIG. 4 shows a cross sectional view of a shadow mask type color picture tube. The outer side of the color picture tube is constructed from a panel 1 having a box shape and a funnel 3 having a funnel shape. A screen 8 on which a phosphor has been applied is provided on the inner surface of the panel 1, and a shadow mask 2 is positioned so as to face the screen 8. An electron gun 6 is provided inside neck 5 of the funnel 3. An electron beam 7 emitted from the electron gun 6 deflects by a magnetic field of a deflection yoke 4 positioned at the periphery of the funnel 3, goes through holes of the shadow mask 2 and lands on the screen 8, thus displaying a color image.

Figure 5:
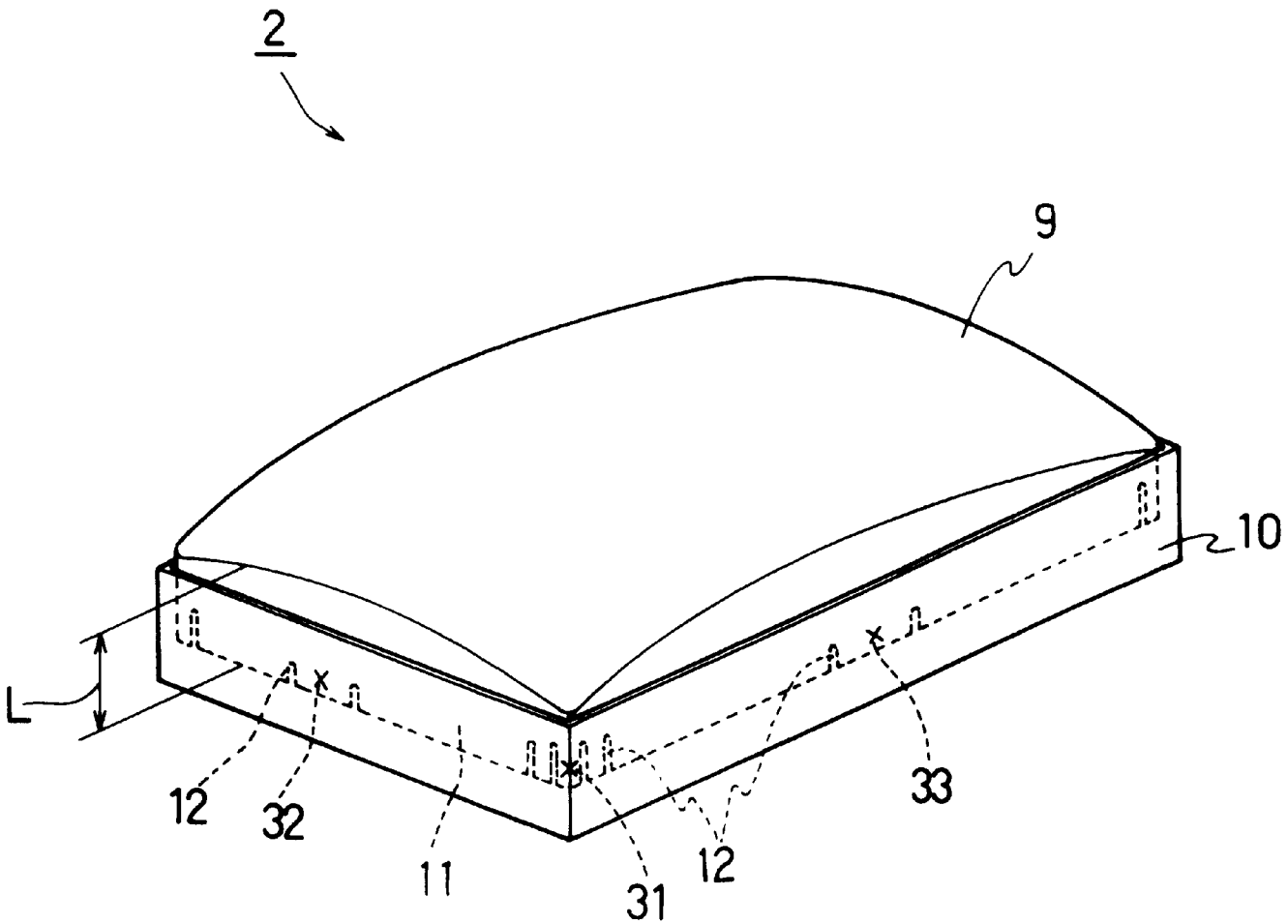
FIG. 5 PRIOR ART
FIG. 5 shows a perspective view of a shadow mask provided in a color picture tube.
Figure 6:
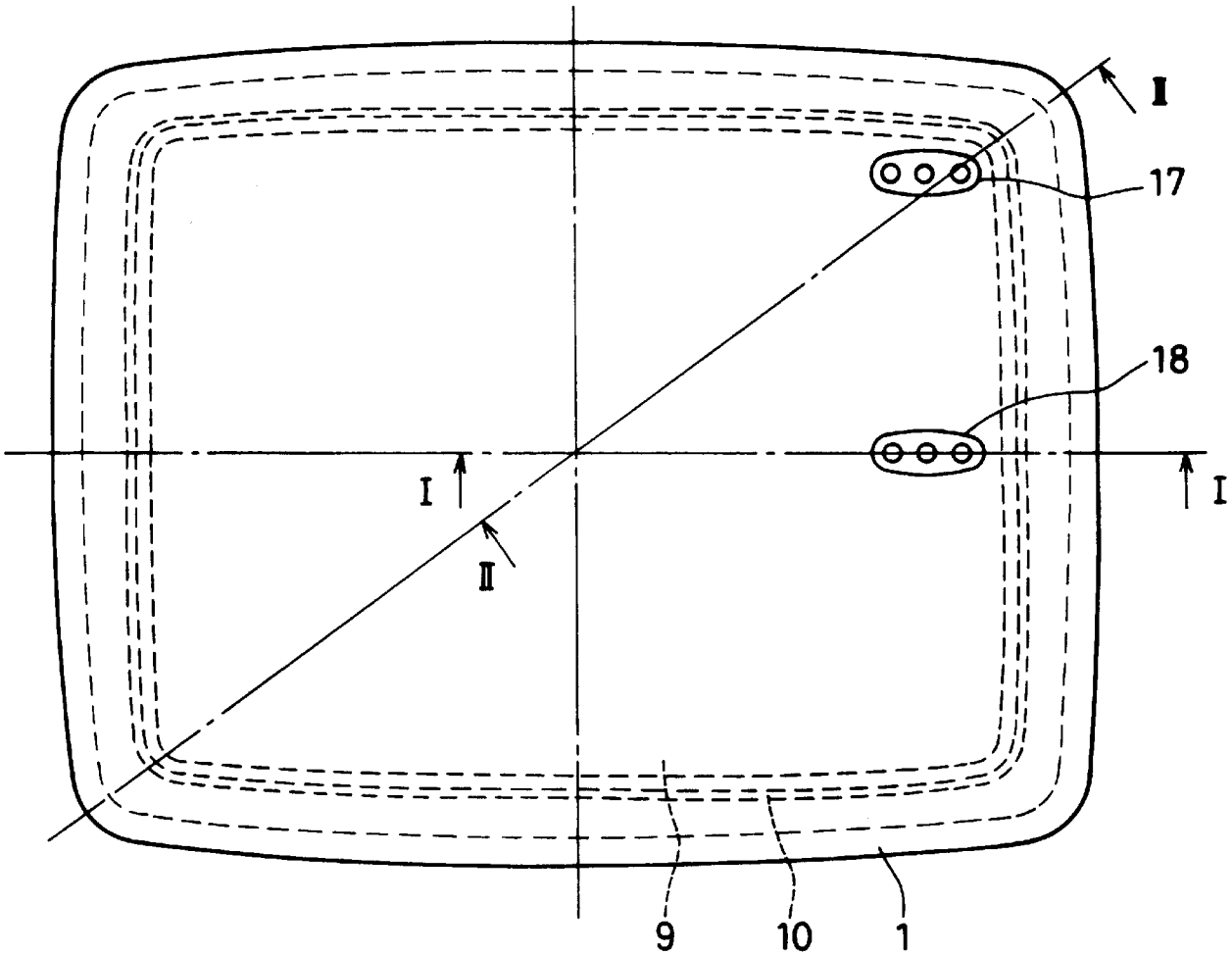
FIG. 6 PRIOR ART
FIG. 6 shows a front view of a color picture tube.
Figure 7:
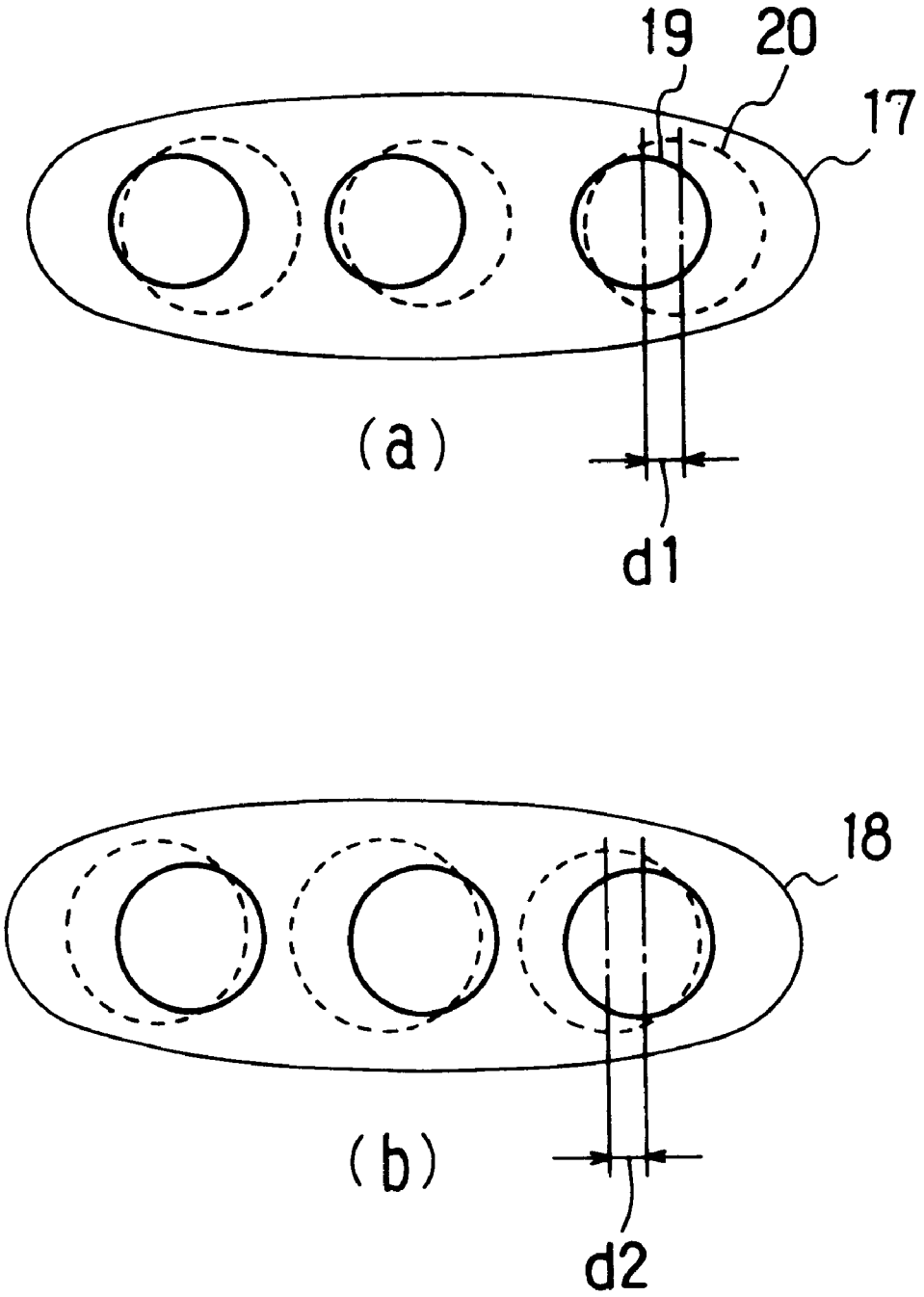
FIG. 7 PRIOR ART
FIG. 7(*a*) and (*b*) show schematic views illustrating the shift between a phosphor hole and an electron beam in the case where a dummy baking treatment has not been conducted on a shadow mask according to conventional techniques, wherein (a) and (b) show a state in the area near corner portions and a state in the area near center portions of the short sides respectively.

FIG. 5 shows a perspective view of the shadow mask 2. The shadow mask 2 shown in FIG. 5 is provided with a body 9 of the shadow mask and a mask frame 10, which are assembled by welding a skirt portion 11 formed around the body 9 and the inner surface of the mask frame 10. In an example shown in FIG. 5, the welding points are provided at spots 31 in corner portions, at spots 32 in center portions of the short sides and at spots 33 in center portions of long sides. In the skirt portion 11, cut parts 12 are formed in the vicinity of the corner portions and the center portions of the short sides. As to the welding points, if the welding points are provided in the upper part of the skirt portion 11 (in the side near to the curved surface of the body 9), the deformation of the curved surface shape is affected greatly by the deformation of the skirt portion 11 in welding. On the other hand, if the welding points are provided in the lower part of the skirt portion 11, there is the case where the position of the welding points can not be secured due to an assembly error or the like. Therefore, the appropriate position of the welding points is determined to be about 2 mm above the lower end of the skirt portion 11.

In seeking for a method and a structure preventing the thermal deformation of the curved surface of a shadow mask without a dummy baking process in the shadow mask constructed as mentioned above, attention came to be paid especially to the height of the welding points in the welding positions in the center portions of short sides and in the corner portions. Nevertheless, the distance (about 2 mm) from the lower end of the skirt portion 11 to a welding point is preferably kept constant in many cases, since there are structural restrictions or the like mentioned above. Then, the structure in which the distortion in welding was absorbed by changing the distance from the welding points to the curved surface of the shadow mask, i.e. by changing the length of the skirt portion 11, was found. The results shown in FIG. 3 were obtained from experiments changing the length of the skirt in the corner portions and in the center portions of the short sides.

Figure 3:
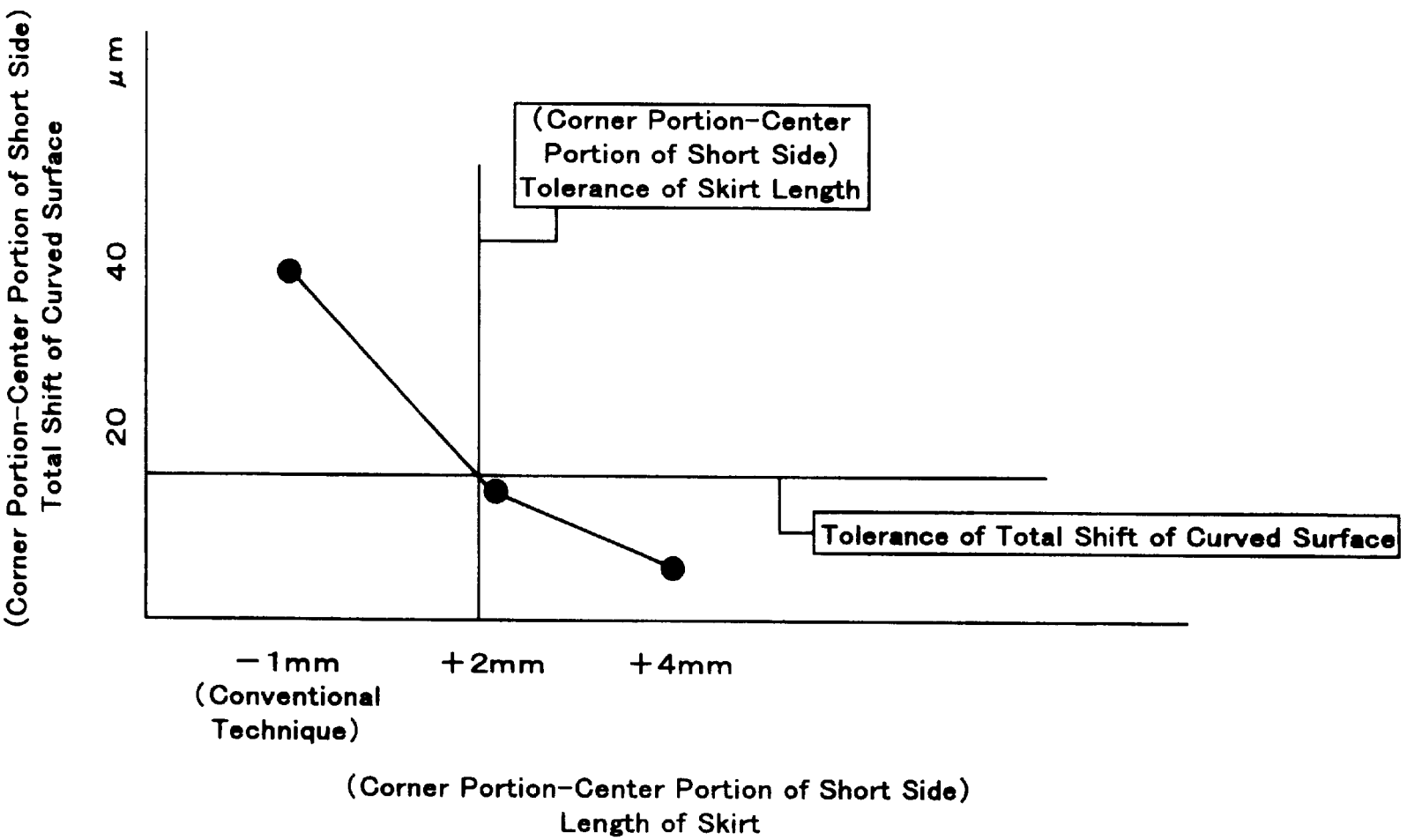
FIG. 3 shows a graph illustrating the relationship between the difference between the length of a skirt in corner portions and the length of a skirt in center portions of the short sides and the shift of a curved surface.

FIG. 3 shows a graph illustrating the relationship between the difference between the length of the skirt in the corner portions and the length of the skirt in the center portions of the short sides and the shift of the curved surface. In this case, the length of the skirt in the center portions of the short sides was kept constant and the length of the skirt in the corner portions was changed. To increase the length of the skirt in the corner portions means to lower the welding position in the skirt portion relatively by increasing the distance between the curved surface in the area near the corner portions and the welding point of the skirt portion.

Figure 8:
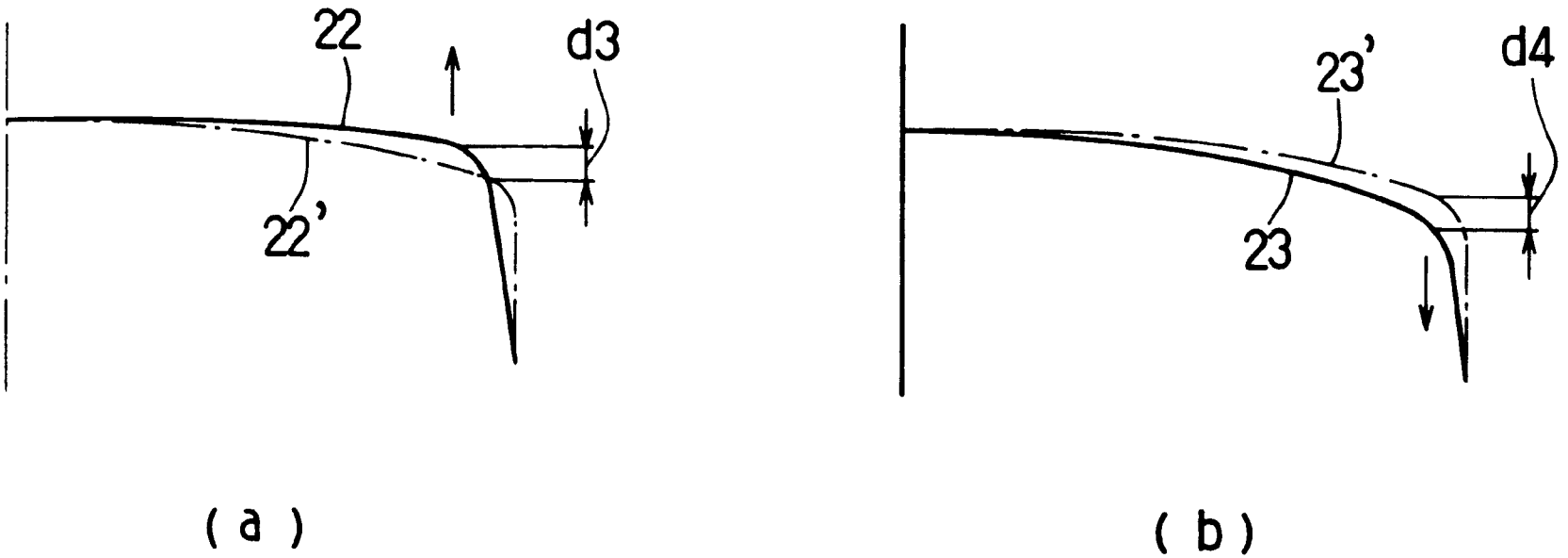
FIG. 8 PRIOR ART
FIG. 8(*a*) and (*b*) show drawings illustrating the change of the curved surface of a mask by a thermal treatment in a color picture tube, wherein (a) and (b) show the change in the area near center portions of the short sides and in the area near corner portions respectively.
Figure 9:
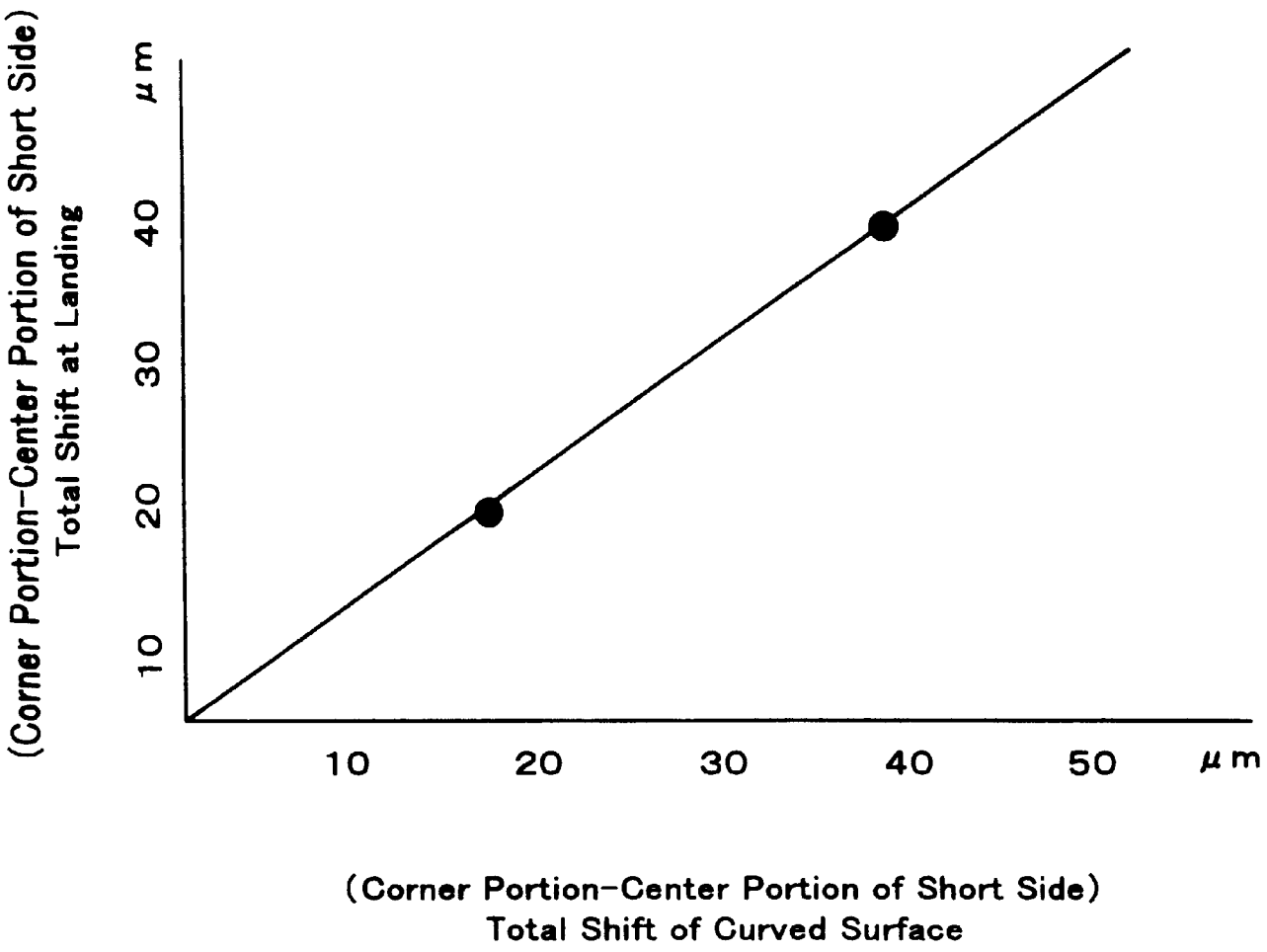
FIG. 9 PRIOR ART
FIG. 9 shows a graph illustrating the relationship between the total of the shift of a curved surface and the total of the shift at landing (the shift between an electron beam and a hole).

As can be seen from FIG. 3, when conducting no thermal treatment while using a shape (the length of the skirt in center portions of the short sides is longer than that in corner portions by 1 mm) according to conventional techniques, the total (d3+d4 in FIG. 8 mentioned above) of the shift of the curved surface is 40 $\mu$m. However, the shift of the curved surface can be reduced by increasing the difference between the length of the skirt in corner portions and the length of the skirt in center portions of the short sides by lengthening the length of the skirt in the corner portions. For example, in the case where the difference in the length of the skirt in corner portions and center portions of the short sides is not shorter than 2 mm, it is possible to restrain the shift of the curved surface to 15 $\mu$m or less (shown in FIG. 3 as "a tolerance for the total of the shift of the curved surface") that is a tolerance for the shift of the curved surface determined from the tolerance limit for the shift at landing based on FIG. 9 mentioned above. That is, the effect of the present invention can be exhibited effectively by forming the skirt portion in the corner portions so as to be longer than the skirt portion in the center portions of the short sides by at least 2 mm. As can be seen from FIG. 3, no substantial difference in the effect can be found in the case of increasing the difference between the length of the skirt portion in corner portions and the length of the skirt portion in center portions of the short sides. Therefore, the difference in the length of the skirt in corner portions and in center portions of the short sides is defined as Formula 1 mentioned above. In the case of using a 36 cm tube, the limitation of the difference between the length of the skirt in corner portions and the length of the skirt in center portions of the short sides was 7 mm due to the structure having a mask frame, and in that case the amount of deformation at landing was almost 10 $\mu$m.

The examination mentioned above is based on the condition that welding points are provided at the positions about 2 mm above the lower end of the skirt portion. However, the same effect can be obtained if the welding points are provided in the same way as mentioned above regardless of the length of the skirt portion. That is, it was confirmed that the shift of the curved surface was reduced effectively, also in the case where the welding point 32 in the center portion of the short side is provided so as to be nearer to the curved surface 9' of the shadow mask than is the straight line that links two welding points 31*a* and 31*b* in two corner portions, between which the welding point 32 is positioned in FIG. 1. Moreover, as shown in FIG. 3, it was also confirmed that the shift of the curved surface was restrained to 15 $\mu$m or less, which is an acceptable tolerance for the shift of the curved surface determined from the tolerance limit for the shift at landing, by setting the distance d between the welding point in the center portion of the short side and the straight line that links two welding points, each of which is positioned in a corner portion and between which the welding point in the center portion is positioned, to be at least 2 mm. It is preferable that the maximum of the distance is shorter than 15 mm, since the effect of decreasing the shift of the curved surface can not be expected to increase greatly in the case of making the distance too long and it is disadvantageous in terms of productivity and cost.

Based on the results mentioned above, a shadow mask mentioned below was formed as an example.

Figure 1:
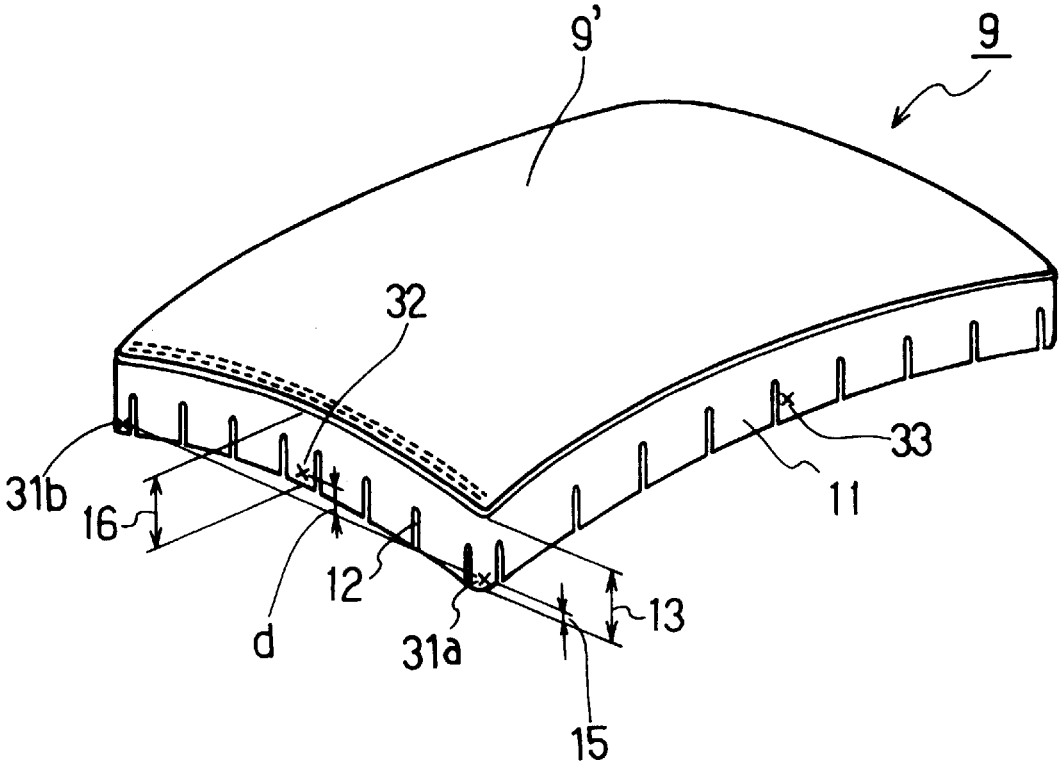
FIG. 1 shows a perspective view of a body of a shadow mask according to an embodiment of the present invention.

FIG. 1 shows a schematic drawing of a body of a shadow mask according to an embodiment of the present invention. In the embodiment, the explanation is directed to the case where a shadow mask having a 36 cm tube is formed, wherein a body 9 of a shadow mask is made of a plate having a thickness of 0.1 mm using an invar material and a mask frame is made of a plate having a thickness of 1.2 mm using a soft steel material.

The height 15 of the welding point in the body 9 in FIG. 1 was determined to be 2 mm above the lower end of a skirt portion 11 in corner portions, center portions of the short sides and center portions of the long sides as mentioned above. The length 13 of the skirt portion at welding points in the corner portions, the length 16 of the skirt portion at welding points in the center portions of the short sides and the length (not shown in FIG. 1) of the skirt portion at welding points in the center portions in the long sides are determined to be 16 mm (conventionally 11 mm), 12 mm (same as a conventional length) and 15 mm (conventionally 14.5 mm) respectively. In this embodiment, the difference between the length of the skirt in corner portions and the length of the skirt in center portions of the short sides was 4 mm.

When forming a shadow mask 2 using the body 9 and the mask frame 10 as mentioned above, the skirt portion in the corner portions can effectively absorb the distortion by the heat generated in welding. Thus, when manufacturing a color picture tube using this shadow mask 2, it was possible to reduce the deformation of the curved surface of the body 9 caused by the distortion in welding the shadow mask 2 or the like in a thermal process. Consequently, a color picture tube having an equivalent quality with a color picture tube manufactured by conducting a conventional dummy baking process was obtained. It can be considered that this was enabled by obtaining the same effect as a pre-bake that can prevent the curved surface from being changed from the reference curved surface by forming the body 9 so as to have such a shape mentioned in this embodiment (by absorbing the distortion caused by the heat generated in welding by controlling the length of the skirt portion).

Consequently, the same quality as in the case where color purity in a color cathode-ray tube was maintained by conducting a conventional dummy baking process can be obtained without conducting a dummy baking process by using the shadow mask 2 according to the present invention.

Figure 2:
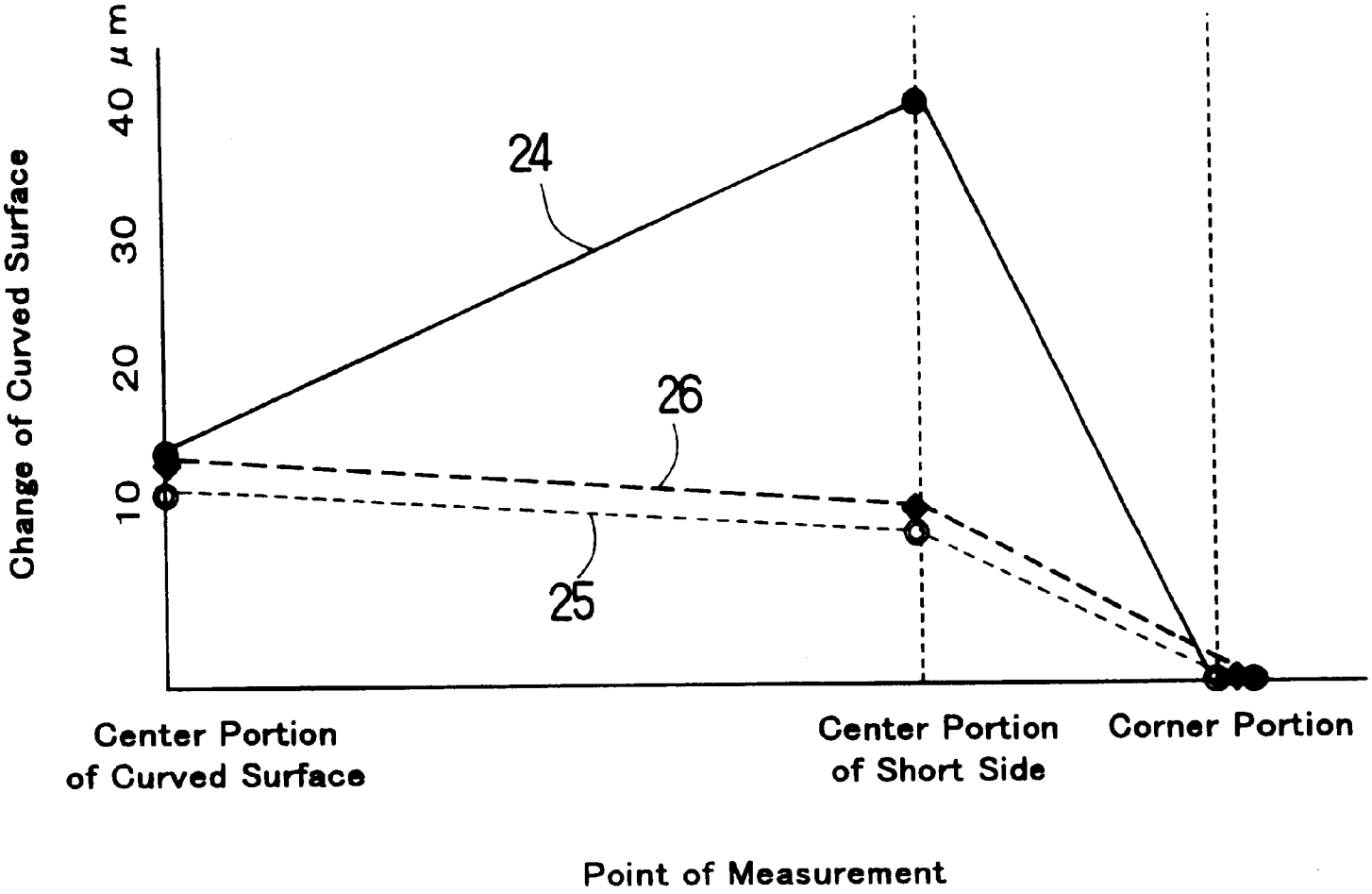
FIG. 2 shows a graph illustrating an amount of deformation of a curved surface during a thermal process in a shadow mask according to the present embodiment and in a shadow mask according to conventional techniques.

Such an effect of the present invention will be explained concretely using FIG. 2. FIG. 2 shows a graph illustrating the amount of deformation of a curved surface during a thermal process in a shadow mask according to the present embodiment and in a shadow mask according to conventional techniques. In both cases, the shadow mask 2 is a 36 cm invar mask. Three measurement points (a center portion of the shadow mask, an area near a center portion of a short side and an area near a corner portion) of the amount of deformation of a curved surface are indicated in the horizontal axis. The vertical axis indicates the amount of deformation of the curved surface by a thermal process at each measurement point. In the graph, the volume of deformation in the area near the corner portion is regarded as a reference, and the amount of deformation at the other measurement points is indicated as a relative amount of deformation for the area near the corner portion. In this graph, the mark "●" indicates an amount 24 of deformation of the curved surface of the body of a shadow mask according to conventional techniques in the case of conducting a thermal treatment once, the mark "◆" indicates a volume 26 of deformation of the curved surface of the body of the shadow mask according to conventional techniques in the case of conducting two thermal treatments and the mark "◎" indicates a volume 25 of deformation of the curved surface of the body of the shadow mask according to the present embodiment in the case of conducting a thermal treatment once. In this case, "conducting two thermal treatments" means to be subjected to thermal load twice in total by a dummy baking process and by a frit sealing process, an exhaust process and the like, and "conducting a thermal treatment once" means to be subjected to the heating only by a frit sealing process, an exhaust process and the like without conducting a dummy baking.

As can be seen from FIG. 2, the amount 25 (◎) of deformation of the curved surface of the body according to the present embodiment is almost in the same level compared to the amount 26 (◆) of deformation of the curved surface of the body according to conventional techniques (conducting two thermal treatments). On the other hand, the difference in the amount of deformation of the curved surface is great in the center portions of the short sides when comparing the amount 25 (◎) of deformation of the curved surface of the body according to the present embodiment with the amount 24 (●) of deformation of the curved surface of the body according to conventional techniques (conducting a thermal treatment once). That is to say, FIG. 2 shows that a better result (having a small amount of deformation of the curved surface) is obtained in the body according to the present embodiment than in the body according to conventional techniques in the case of conducting the same treatment. Moreover, the shift at landing can be restrained to 15 μm or less (the tolerance) as mentioned above referring to FIG. 9, since the amount 25 (◎) of deformation of the curved surface of the body according to the present embodiment is restrained to 15 μm or less at all the measurement points.

As explained above, in the present embodiment the thermal expansion in welding is relieved in the skirt portion by lengthening the skirt portion in corner portions. However, if merely the skirt portion is lengthened, the stiffness in the vicinity of the welding parts in corner portions becomes greater than that in the conventional one. Then, the effect on the curved surface of the body affected by the condition in the vicinity of the welding parts in corner portions also becomes great. Therefore, the present embodiment is constructed so as to relieve the stiffness and the thermal expansion in the vicinity of the welding parts in corner portions by controlling the position of cut parts near the welding parts and their size. As a result, the present embodiment allows the effect on the curved surface shape of the body by a thermal expansion in welding to be reduced to the level having no substantial problem. The position and the size of the cut parts in the skirt portion may be determined suitably considering the size and the curved surface shape of a shadow mask, the material and the thickness of a body of a shadow mask and a mask frame, welding conditions and the like.

In the explanation above, a 36 cm (15 inch type)-90° deflecting invar mask tube (curvature=2R) was used. However, in the case of applying to a color picture tube having a difference in a size, a deflection angle and curvature of a face panel, the shift of the curved surface of a mask for the shift at landing is naturally different in each case.

In the present embodiment, the explanation was made using a 36 cm tube, but the present invention should not be limited to this. For example, also in the case of using other sizes or types (for example, a large tube, a wide tube or the like), the same effect as in the above embodiment can be obtained by controlling the length of the skirt portion 11 in the welding parts on the diagonal axis within the range of the present invention according to the conditions such as the plate thickness, the curved surface shape and the like. As the size of the color picture tube becomes larger (than a 36 cm tube mentioned above), the difference between the skirt length in the corner portions and the skirt length in the center portions of the short sides or the distance between a fixing point in a center portion of a short side and the straight line that links two fixing points, each of which is positioned in a corner portion and between which the fixing point in the center portion is positioned, naturally becomes larger than that in a 36 cm tube mentioned above. That is, in the case of using a 36 cm tube, the limit of the difference in the skirt length in the corner portions and in the center portions of short sides or the distance mentioned above was 7 mm, but in the case of using a tube larger than a 36 cm tube, the limit of the difference in the skirt length or the distance mentioned above becomes also greater than 7 mm.

In the present embodiment, the explanation was made for the case where a shadow mask was manufactured using an invar mask without conducting a dummy baking. However, the present invention is not limited to this embodiment. For example, in the case of using an AK mask, the effect reducing the deformation of the curved surface by a thermal treatment can be obtained by employing the present invention.

This invention should be considered as defined by the appended claims rather than as limited to the embodiment mentioned above.

What is claimed is:

1. A shadow mask, comprising a body of a shadow mask having a peripheral skirt portion and short sides, and a mask frame surrounding the body, wherein cut parts are formed in the skirt portion in the vicinity of corner portions and center portions of the short sides of the body, the skirt portion and the inner surface of the mask frame are fixed at least at the corner portions and the center portions of the short sides and each fixing point in the center portions of the short sides is positioned nearer to the curved surface of the shadow mask than is a straight line that links two fixing points, each of which is positioned in a corner portion and between which the fixing point in the center portion of the short side is positioned.

2. A shadow mask according to claim 1, wherein the distance between the fixing point in the center portion of the short side and the straight line that links two fixing points is shorter than 15 mm but not shorter than 2 mm.

3. A color picture tube comprising the shadow mask according to claim 2.

4. A color picture tube comprising the shadow mask according to claim 1.

5. A shadow mask, comprising:

a shadow mask body having a peripheral skirt portion and short sides; and a mask frame surrounding the body;

wherein cut parts are formed in the skirt portion in the vicinity of corner portions and center portions of the short sides of the body, the skirt portion and an inner surface of the mask frame are fixed at least at the corner portions and the center portions of the short sides and the distance from each fixing point to a curved surface of the body of the shadow mask at the corner portions is longer than that at the center portions of the short sides.

6. The shadow mask according to claim 5, wherein the difference between the distance from each fixing point to the curved surface of the body of the shadow mask at the corner portions and that at the center portions of the short sides is shorter than 15 mm but not shorter than 2 mm.

7. A color picture tube comprising the shadow mask according to claim 5.

* * * * *